United States Patent [19]

Barrett et al.

[11] 3,946,500

[45] Mar. 30, 1976

[54] TUMBLER DRUM FOR A DOMESTIC APPLIANCE

[75] Inventors: Colin Barrett, Halifax; Peter Cash, Brighouse, both of England

[73] Assignee: U.S. Philips Corporation, New York, N.Y.

[22] Filed: May 28, 1974

[21] Appl. No.: 473,889

[30] Foreign Application Priority Data

June 14, 1973 United Kingdom ..... 28337/73

[52] U.S. Cl. ..... 34/139; 68/142; 259/81 R

[51] Int. Cl.[2] ..... F26B 11/02

[58] Field of Search ..... 34/76, 82, 130, 131, 132, 34/133, 134, 138, 139, 140, 239–241; 68/142, 144; 259/81 R

[56] References Cited

UNITED STATES PATENTS

| | | | |
|---|---|---|---|
| 1,169,782 | 2/1916 | Eden | 68/142 |
| 2,751,688 | 6/1956 | Douglas | 259/81 R |
| 3,064,361 | 11/1962 | Turner | 34/133 |
| 3,257,736 | 6/1966 | Lachat et al. | 34/133 |
| 3,605,281 | 9/1971 | Hubbard et al. | 34/133 |
| 3,815,258 | 6/1974 | Beard, Jr. | 34/133 |

FOREIGN PATENTS OR APPLICATIONS

| | | | |
|---|---|---|---|
| 1,190,128 | 3/1959 | France | 68/142 |

*Primary Examiner*—Kenneth W. Sprague
*Assistant Examiner*—James C. Yeung
*Attorney, Agent, or Firm*—Frank R. Trifari; David R. Treacy

[57] ABSTRACT

A drum for a tumbler drier or washing machine is assembled from front and rear pressings and a wrapper, each secured only to a set of lifters to form a rigid construction. Plastic lifters and pre-coated metal parts eliminate a need for painting after assembly.

3 Claims, 4 Drawing Figures

TUMBLER DRUM FOR A DOMESTIC APPLIANCE

THIS INVENTION relates to domestic appliances, and more particularly to construction of a drum for a tumbler drier or washing-machine in which the drum is assembled from component parts without the need for welding or lock-seaming equipment.

A drum of this kind is formed normally in a cylindrical shape with a curved wrapper held between essentially flat back and front pressings. The wrapper carries inwardly-directed lifters which serve during rotation of the drum to lift its contents, thus, in the case of a tumbler drier, allowing these to fall through a stream of warm air passing through the drum. The drum contents therefore become gently agitated in the warm air stream, so that after a suitable time interval they are dried.

The drum will usually have at least three lifters but this number can easily be four or more so that a suitable degree of agitation will be provided for a given speed of rotation.

In the construction of a drum for a tumbler drier it is usual to provide special equipment for a welding or lock-seaming operation to join together the separate parts of the drum. This equipment is costly to install and it is necessary also at an early stage to take into account what plant may be already available for providing a protective interior surface coating to the completed assembly. With a painting operation using a dipping or electrophoretic process there may be no special difficulty in coating the interior of the drum. However, a conventional automatic electrostatic paint plant is not so suitable for this task.

We have now found a way of constructing a drum in which the need for a separate painting operation on the interior surface of the assembled drum can be avoided.

According to the invention, there is provided a drum for a domestic appliance, the drum comprising back and front pressings, a wrapper and lifters, in which the wrapper and back and front pressings are secured to the lifters to form a hollow, rigid construction. Conveniently, the lifters are provided with integral sockets into which suitable screws can be fastened.

The wrapper may be made of a pre-painted sheet steel material. This paint coating may be of a very tough paint composition such as one incorporating an epoxy resin. This is a particularly suitable treatment for the wrapper since this part of the drum has to withstand any hammering or scratching that may occur during operation of the drier due to buttons, buckles or other hard parts attached to the clothes.

The back and front pressings may be made of pre-painted sheet steel.

The invention also comprises a tumbler drier or washing-machine including a drum the parts of which are secured together by means of the lifters.

By way of example an embodiment of the invention will be further described with reference to the accompanying drawings, in which.

Figure 1:
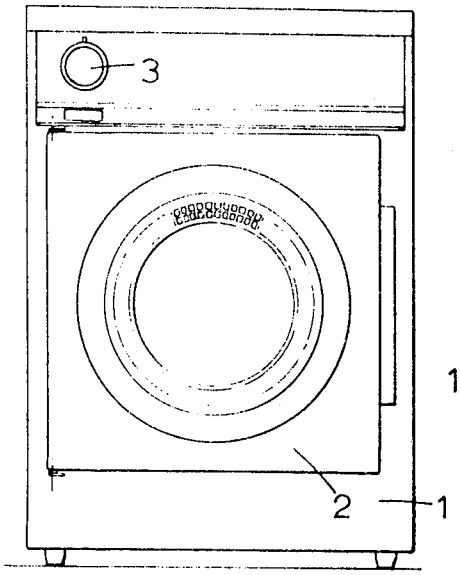
FIG. 1 is a front view of the complete tumbler drier.

As shown in FIG. 1, the tumbler drier comprised a cabinet 1, having a door 2 through which clothes for drying could be passed into the rotatable drum of the drier. The duration of the drying operation is set by means of a timer dial 3 and during this period the drum is rotated whilst warm air is passed through the drum. The damp air leaving the drum is discharged through an outlet in the rear face of the cabinet.

Figure 2:
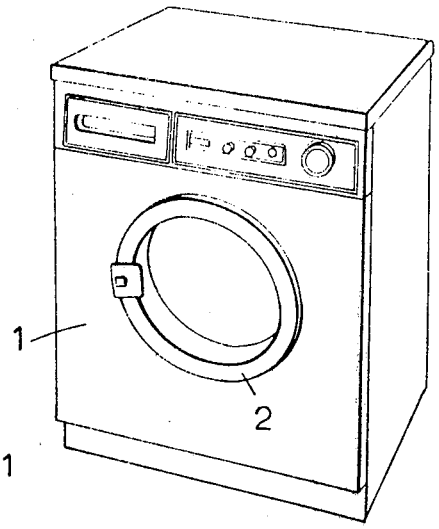
FIG. 2 is a perspective view of a front-loading type of washing-machine.

FIG. 2 shows a front-loading washing-machine having a cabinet 1 and door 2.

Figure 3:
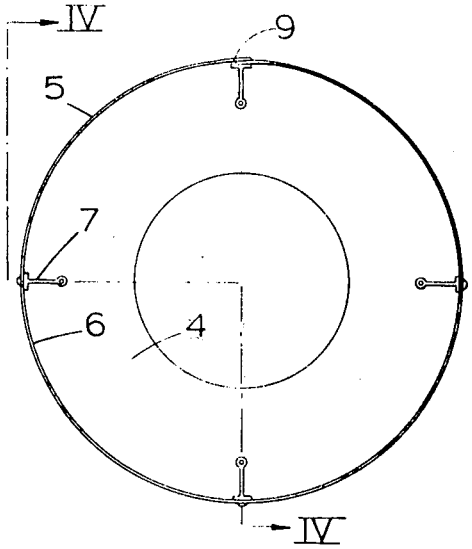
FIG. 3 is a rear view of the drum with the back pressing removed.
Figure 4:
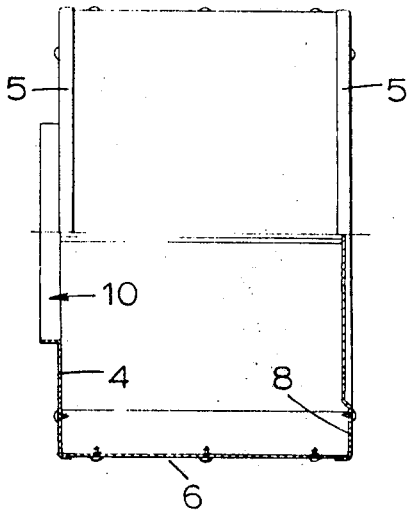
FIG. 4 is a sectional view of the complete drum taken along the line IV—IV on FIG. 2.

FIG. 3 gives a view of the drum with the back pressing removed. The front pressing 4 is a circular shape with a raised flange 5 located round its periphery. Within the flange 5, the wrapper 6 is positioned and the wrapper is then held in place by means of self-tapping screws through the front pressing 4 which are fixed in the lifters 7. Each lifter is also secured to the wrapper by means of three screws as can be seen more clearly in FIG. 4.

A back pressing 8, similar in shape to the front pressing 4 and also having a peripheral flange, is then fixed over the wrapper and is also secured by screws.

The back and front pressings in this example were electrostatically painted as a suitable plant was available. The wrapper was a pre-painted sheet steel material. The lifters were made of a molded thermoplastics material having integral sockets for receiving self-tapping screw fasteners.

Leakage of air from between the flanges 5 and the wrapper 6 was prevented by means of strips of self-adhesive tape which were applied to the outside of the wrapper to cover these joints.

A joint 9 at the ends of the wrapper was arranged to occur beneath one of the lifters 7. This joint also was sealed against leakage of air by means of a strip of tape.

The back pressing had a large number of perforations while the front pressing included a large central opening 10 which co-operated with suitable air ducting for feeding the air supply into and out of the drum.

When required for use in a washing-machine, the drum may be provided with a wrapper of perforated sheet metal and the back pressing may be attached to a horizontal shaft for mounting and rotating the drum.

The drum of the invention was found to be capable of being built with only very simple tools, yet it formed an extremely rigid and robust construction. The problem of painting the internal surfaces was overcome by using pre-painted sheet material and in this way the coating of the wrapper for example may be chosen to have optimum abrasion resistance for the work that this part has to do.

The foregoing description of an embodiment of the invention has been given by way of example only and a number of modifications may be made without departing from the scope of the invention. For example, it is not essential that the wrapper should be made of a painted steel material and for a particular application this could be made alternatively of a stainless steel or a plastics-coated steel. The back and front pressings could be made of pre-painted material instead of being electrostatically painted.

What we claim is:

1. A drum for a domestic appliance, said drum comprising a back pressing, a front pressing, a wrapper, a plurality of lifters each having a side and two ends, a plurality of securing devices fastening the back pressing to one end of each lifter, a plurality of securing devices fastening the front pressing to the other end of each lifter, and a plurality of securing devices fastening the wrapper to said lifter sides such that the pressings and wrapper from the ends and side of a drum respectively, structural connection of the pressings to the wrapper being provided by said securing devices solely.

2. A drum as claimed in claim 1 in which the lifters are formed of a plastic material molded with integral sockets for receiving self-tapping screws, and said securing devices are self-tapping screws.

3. A device as claimed in claim 2, in which the wrapper is formed of a pre-coated material.

* * * * *